US005299558A

United States Patent [19]

Binzer

[11] Patent Number: 5,299,558

[45] Date of Patent: Apr. 5, 1994

[54] MODULAR FIREPLACE INSERT

[76] Inventor: Lothar Binzer, 5721 124th Street, Surrey, British Columbia, Canada

[21] Appl. No.: 945,530

[22] Filed: Sep. 16, 1992

[51] Int. Cl.[5] ..... F24C 3/00

[52] U.S. Cl. ..... 126/512; 126/523; 126/531; 126/318; 285/325

[58] Field of Search ..... 126/512, 523, 531, 318; 285/325, 326

[56] References Cited

U.S. PATENT DOCUMENTS

| | | | |
|---|---|---|---|
| 2,385,450 | 9/1945 | Koppel | 126/307 A |
| 2,734,501 | 2/1956 | Fauser | 126/307 A |
| 3,552,377 | 1/1971 | Hodges . | |
| 3,614,949 | 10/1971 | Goodgion . | |
| 3,741,194 | 6/1973 | Herron . | |
| 3,842,821 | 10/1974 | Juris | 126/512 |
| 4,259,941 | 4/1981 | Gerdes . | |
| 4,519,376 | 5/1985 | Schoeff et al. | 126/531 |
| 4,683,623 | 8/1987 | Cannata | 126/318 |
| 4,793,322 | 12/1988 | Shimek et al. | 126/512 |
| 4,852,584 | 12/1988 | Shimek et al. . | |
| 4,940,042 | 7/1990 | Moore, Jr. et al. . | |
| 5,009,219 | 4/1991 | Liet | 126/523 |
| 5,092,313 | 3/1992 | Blackburn et al. . | |

FOREIGN PATENT DOCUMENTS

| | | |
|---|---|---|
| 1295899 | 2/1992 | Canada . |
| 847141 | 9/1960 | United Kingdom . |

*Primary Examiner*—Carroll B. Dority
*Attorney, Agent, or Firm*—Flehr, Hohbach, Test, Albritton & Herbert

[57] ABSTRACT

A fireplace insert for a fireplace cavity that includes a venting passage comprising an enclosure dimensioned to be insertable within the fireplace cavity and fill substantially the entire cavity to define a combustion chamber. A passage and an aperture are provided for communicating the combustion chamber with the venting passage. There is a connection system for quickly and efficiently connecting the enclosure to the venting passage while the enclosure is within the fireplace cavity. The ability to connect the insert to the existing venting passage while in place permits the full fireplace cavity to be used. Previous inserts of this type were substantially smaller since there had to be room to manoeuvre and attach the vent by physically reaching into the fireplace cavity.

16 Claims, 6 Drawing Sheets

34
36
2
32
32
30
28
38
39
26
38
16
6
10
14
12

MODULAR FIREPLACE INSERT

FIELD OF THE INVENTION

This invention relates generally to a fireplace construction unit and more specifically to an insert for an unfinished fireplace cavity.

BACKGROUND OF THE INVENTION

Traditional masonry fireplaces designed to burn wood or coal as fuel are no longer being built in today's modern houses. These old style fireplaces are not particularly effective at heating the room in which they are located and they tend to be rather dirty due to the nature of the fuel being used and hence they require constant cleaning and general maintenance. The fireplaces are also susceptible to downdrafts through the venting chimney stack. A further disadvantage is that relatively large areas need to be set aside to store fuel for burning.

In view of the foregoing disadvantages of traditional masonry fireplaces, it is not surprising that there has been a move to cleaner and more efficient gas fireplaces. Generally, the newer style of gas fireplace comprises an insert that is fitted into a preformed cavity built into the wall of a dwelling and connected to a flexible venting duct that is already in place. Making the connection between the insert and the venting duct has in the past restricted the size and configuration of the insert. The insert has to be substantially smaller than the fireplace cavity since there has to be room about the insert to reach in and manoeuvre the venting duct to connect the duct to the insert. This is especially true of fireplace inserts being retro-fitted into older style fireplace cavities.

SUMMARY OF THE INVENTION

The present invention addresses the problems of prior art fireplace inserts by providing an insert that can be sized to fill substantially the entire fireplace cavity available while still ensuring that the insert can be efficiently and reliably connected to the venting passage of the fireplace cavity.

The insert of the present invention is light weight for ease of manoeuvring and provides a pleasing, full-sized fireplace appearance when installed.

Accordingly, the present invention provides a fireplace insert for a fireplace cavity in a building that includes a venting passage comprising:

an enclosure dimensioned to be insertable within the fireplace cavity filling substantially the entire cavity to define a combustion chamber for generating heat;

passage means and an aperture for communicating the combustion chamber with the venting passage; and means for sealably connecting the aperture and the venting passage.

BRIEF DESCRIPTION OF THE DRAWINGS

Aspects of the present invention are illustrated, merely by way of example, in the accompanying drawings in which.

DESCRIPTION OF THE PREFERRED EMBODIMENT

Figure 1:
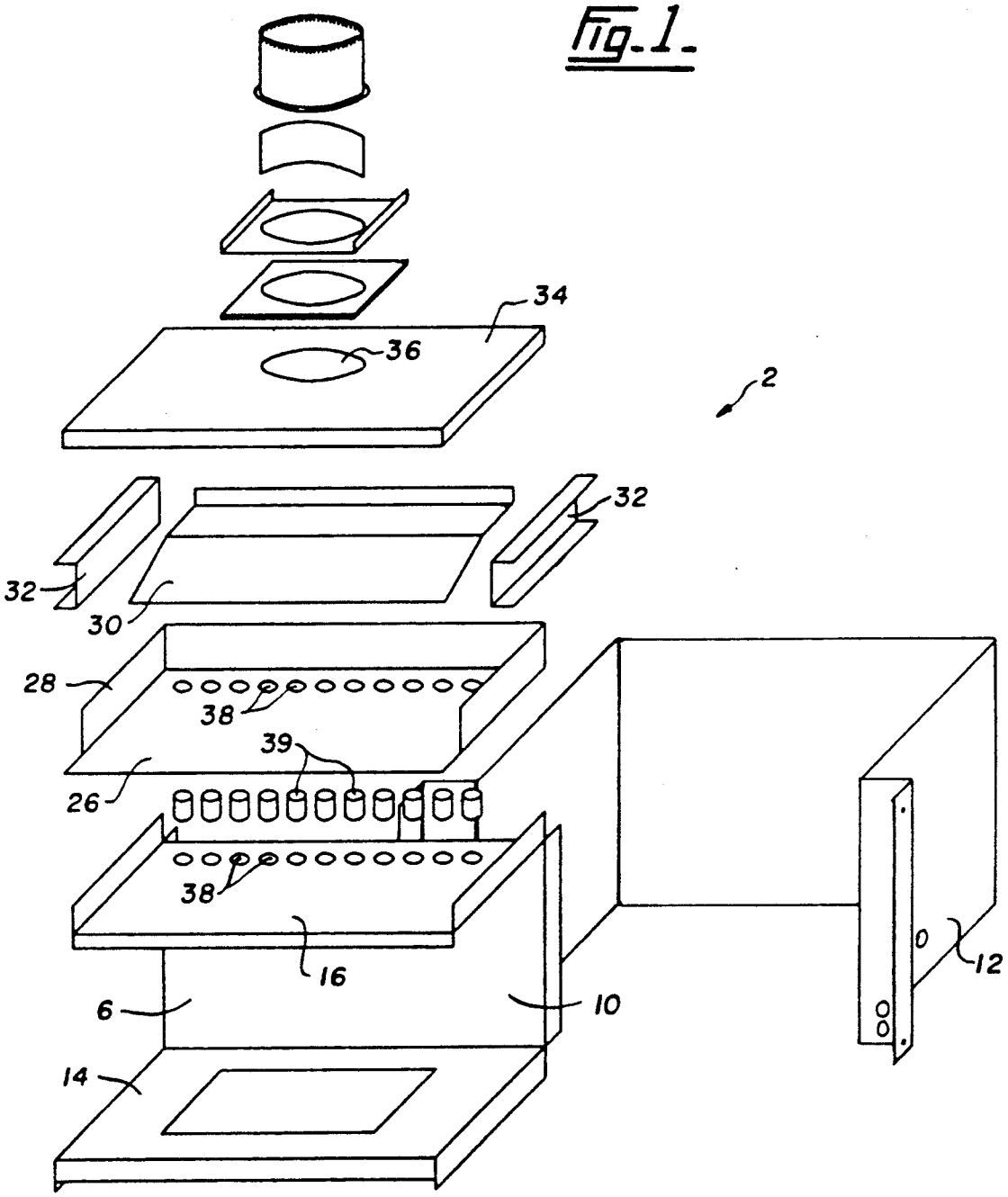
FIG. 1 is an exploded view showing the modular components of the fireplace insert.

Referring to FIG. 1 there is shown an exploded view of a fireplace insert 2 according to a preferred embodiment of the present invention for installation in a preformed fireplace cavity formed in a building wall. The fireplace cavity is provided with a venting passage such as flexible duct 4 illustrated in FIGS. 4–6 that exhausts combustion gases to atmosphere.

Figure 2:
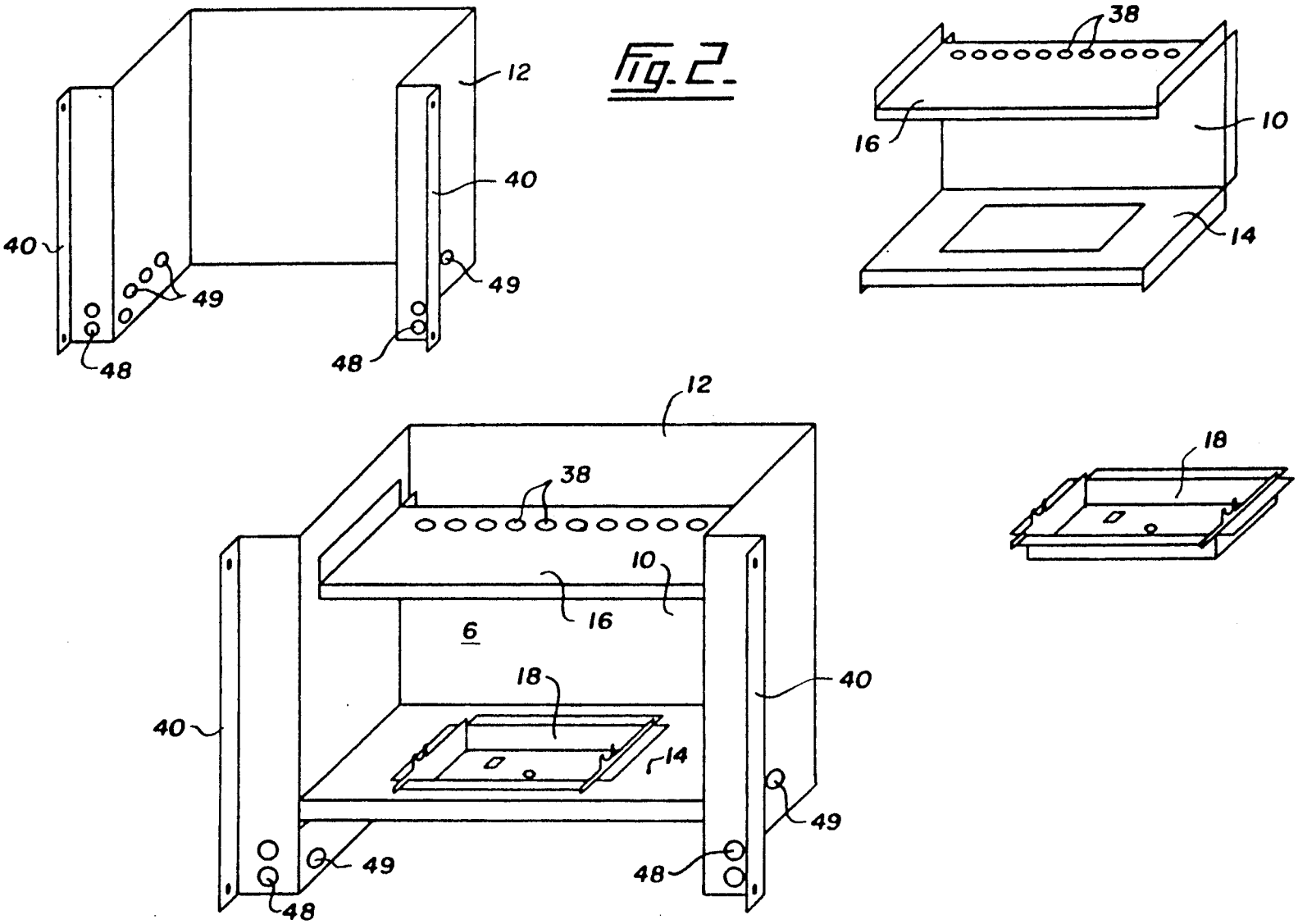
FIG. 2 is an exploded detail view showing the components of the combustion chamber.
Figure 3:
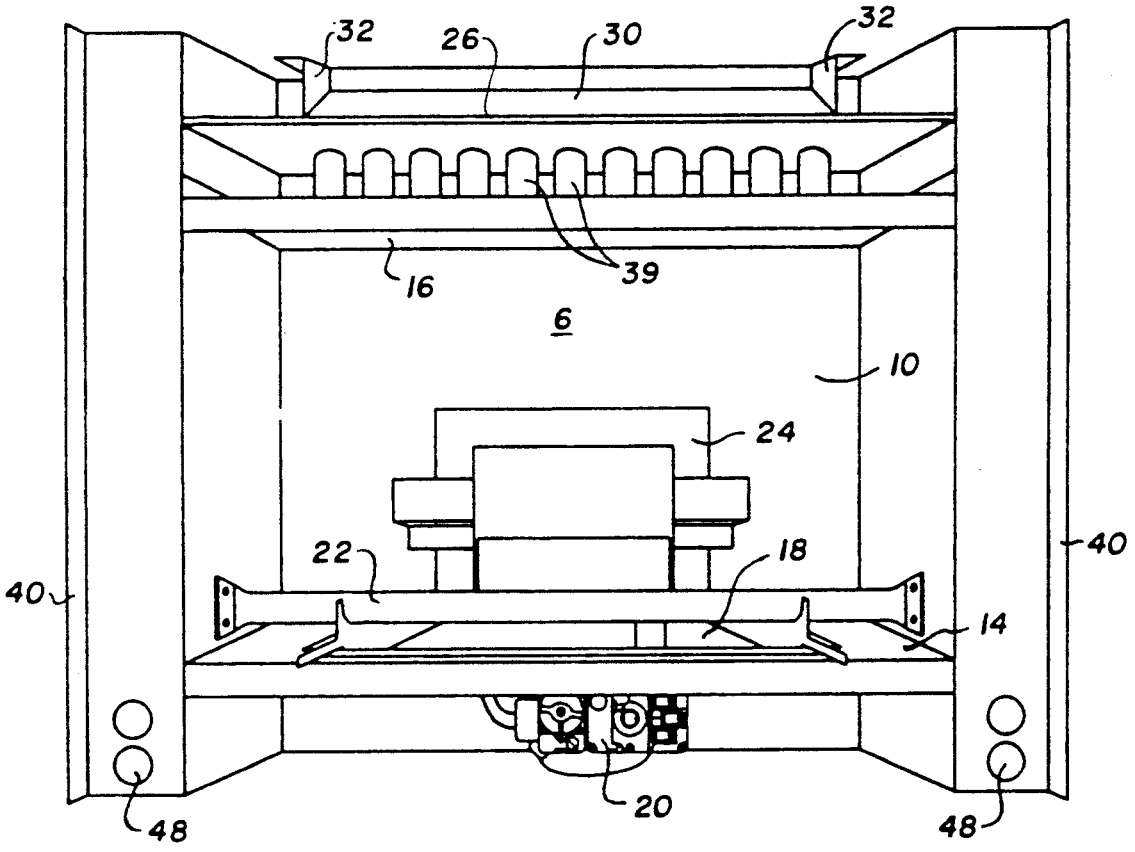
FIG. 3 is a front elevation view of the fireplace insert of the present invention.

Insert 2 is preferably constructed from sheet metal components that are fitted together to create an enclosure appropriately dimensioned to be insertable within a fireplace cavity to fill substantially the entire cavity. The enclosure includes a combustion chamber 6 for generating heat. As best shown in FIGS. 1 and 2, combustion chamber 6 is preferably formed from an essentially U-shaped insert 10 fitted within an outer casing 12. Insert 10 has a lower base panel 14 and an upper roof panel 16. Lower base panel 14 of the inner insert is adapted to accept a burner unit 18 for generating heat. As shown in FIG. 3, burner unit 18 can be a prefabricated unit for burning gas that includes valve controls 20 and an upper burning element 22 where combustion of the gas occurs at a series of spaced gas outlets to generate a plurality of flames. Artificial log support means 24 can be provided to create a combustion chamber 6 that resembles a traditional fireplace hearth.

Referring to FIG. 1, a ceiling panel 26 is fitted above roof panel 16 of insert 10 such that a space is created between the panels. Ceiling panel 26 has upwardly extending walls 28 about three edges. Between the three walls, there is mounted a deflector plate 30 having sides 32. A top panel 34 formed with aperture 36 is mounted atop ceiling panel 26. Aperture 36 is connected to the venting passage of the fireplace cavity. Top panel 34, deflector plate 30 and ceiling panel 26 define a draft hood which will be explained in more detail further on.

Roof panel 16 of insert 10 and ceiling panel 26 are formed with a series of aligned apertures 38. A series of tubes 39 extend between these apertures and act as passage means to communicate the combustion chamber with the draft hood and the venting passage.

Figure 4:
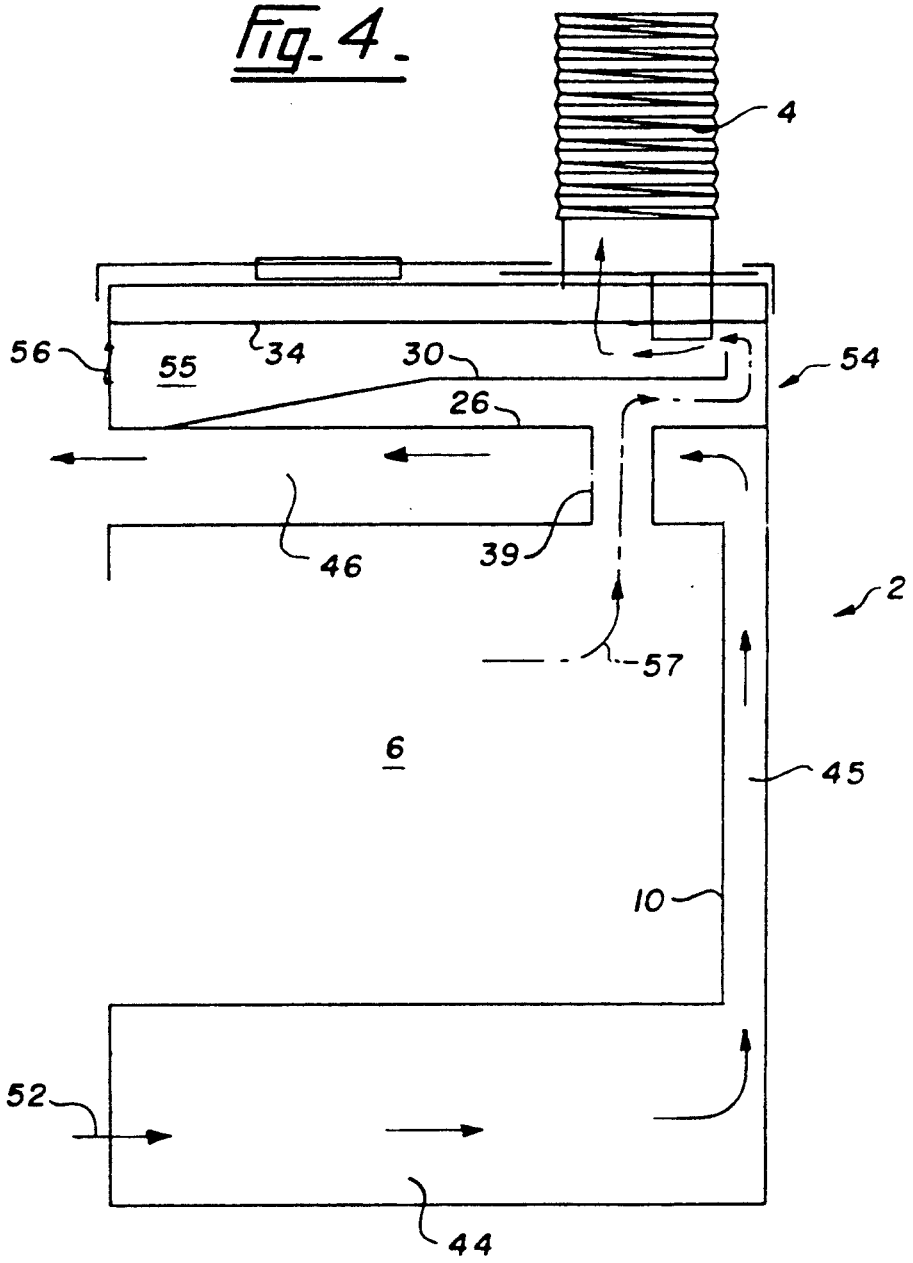
FIG. 4 is a section view through the insert to show passages for gas travel.

FIG. 3 shows an assembled front view of the fireplace insert without top panel 34 showing how the various components interfit to create a fireplace insert. Outer casing 12 is provided with a pair of mounting flanges 40 that anchor the insert into the fireplace cavity and provide mounting support for a facia plate or a tempered glass door (not shown) that extends across the open face of the insert. FIG. 4 is a cross-section through the assembled fireplace insert and illustrates how the various modular components interfit to create a series of chambers that control the flow of heated air and combustion gases through the fireplace insert.

As best shown in FIG. 4, insert 10 is dimensioned such that when secured within outer casing 12 there is clearance between the two components that define a heat exchange cavity about combustion chamber 6. The heat exchange cavity includes cool air inlet cavity 44 below the combustion chamber, air heating chamber 45, and heated air outlet cavity 46 above the combustion chamber. Cool air inlet cavity 44 receives relatively cool room air through apertures 48 and 49 formed in outer casing 12. As cool air passes through cavity 44 and heating chamber 45, it is heated by its close proximity to combustion chamber 6. The heated air rises and passes into heated air outlet cavity 46. In passing into cavity 46, the heated air passes between tubes 39 which conduct the hot combustion gases of combustion chamber 6 to the vent passage. The tubes act to increase the surface area available for heat transfer and thereby increase the rate of heat transfer to the air. From outlet cavity 46, the heated air is delivered back to the room. Arrow 52 in FIG. 4 shows the path of air through the heat exchange cavity. A fan unit (not shown) can be provided to direct air through the heat exchange cavity, however, heating of the air will tend to establish the flow cycle illustrated in FIG. 4.

As previously mentioned, top panel 34, deflector plate 30 and ceiling panel 26 define a draft hood 54 as shown in FIG. 4. Draft hood 54 acts as a means for preventing downdrafts through venting passage 4 from reaching combustion chamber 6 and blowing combustion gases into the room. Draft hood 54 comprises essentially an upper chamber 55 interposed between combustion chamber 6 and venting passage 4. Chamber 55 has a draft outlet 56 into the room. Deflector plate 30 is positioned over the tubes 39 to screen the tubes and deflect downdrafts toward the draft outlet. Combustion gases from chamber 6 follow the winding route shown by arrow 57 about the end of the deflector plate to reach venting passage 4.

Figure 5:
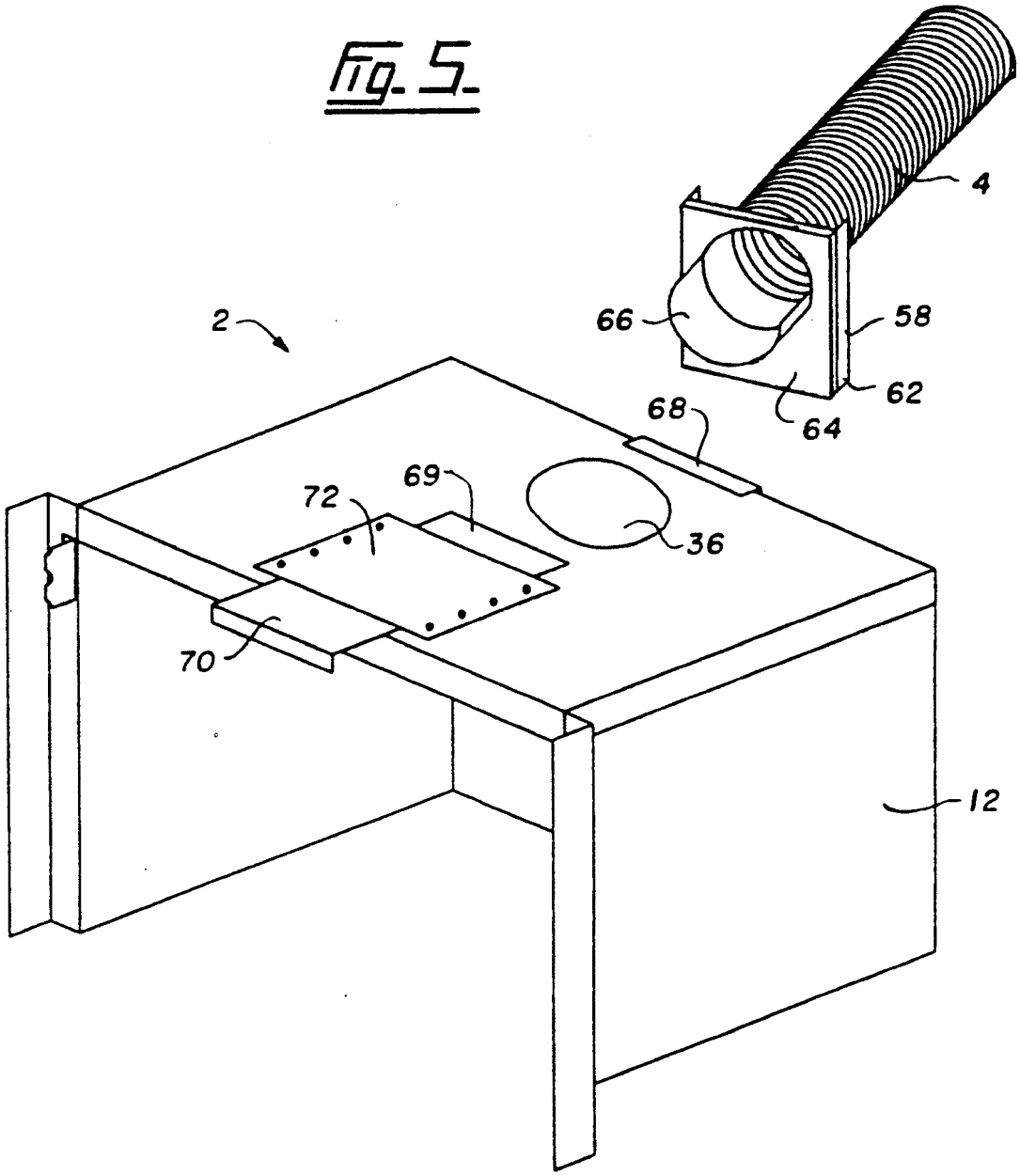
FIG. 5 shows the manner in which the fireplace insert is attached to a venting passage.
Figure 6:
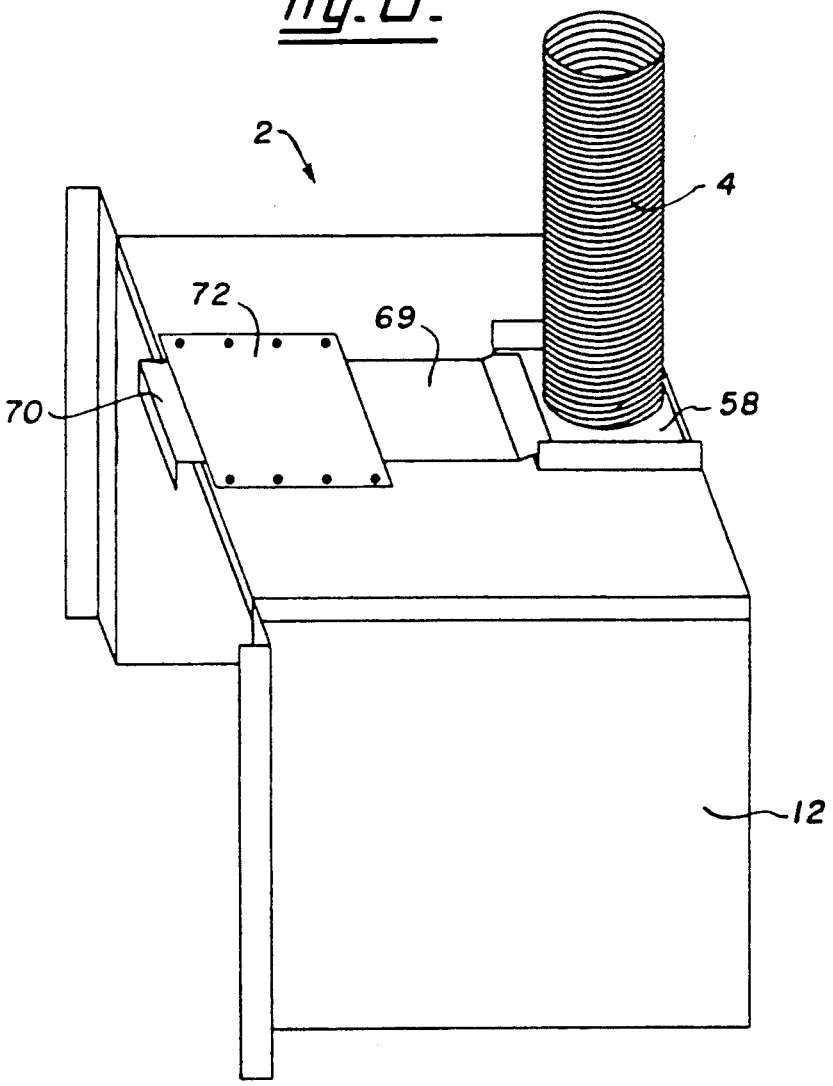
FIG. 6 shows the venting passage attached to the fireplace insert.

FIGS. 5 and 6 illustrate the means for sealably connecting aperture 36 of the insert and venting passage 4. The connecting means of the present invention permit a reliable sealing connection of the venting passage and the aperture in the confines of the fireplace cavity. Venting passage 4 is a flexible tube that can be fitted into an existing fireplace exhaust stack or installed in a new fireplace cavity. In each case venting passage 4 extends into the fireplace cavity for connection to the insert of the present invention.

The means for sealably connecting aperture 36 to venting passage 4 includes an adapter 58 mountable to the end of venting passage 4 for insertion into aperture 36. Adapter 58 comprises a tubular portion for insertion into the vent passage and an attached anchoring plate 62. Anchoring plate 62 is preferably provided with a seal 64 for engagement with the top of the enclosure about aperture 36. A protruding guide flange 66 extends from anchor plate 62 to guide insertion of the adapter into the aperture.

Fixed and movable adapter locking means are provided to secure the adapter in contact with the insert.

The fixed adapter locking means comprise an angled bracket 68 adjacent aperture 36 at the rear of the insert adapted to grip an edge of the attached anchoring plate. The movable adapter locking means comprises an angled bracket 69 mounted to an extension arm 70 positioned to protrude from the fireplace cavity when the insert is positioned therein. The extension arm and bracket are mounted in channel 72 to permit slidable movement between a released position (FIG. 5) and an engaged position (FIG. 6) with respect to adapter anchoring plate 62. Fixed angled bracket 68 and movable angled bracket 69 cooperate to retain anchoring plate 62 in position over aperture 36 atop the fireplace insert.

Installing the fireplace insert of the present invention in a pre-formed fireplace cavity first involves connecting any necessary gas lines and electrical connections to burner unit 18. Adapter 58 is installed within venting passage 4 and the rear edge of the adapter is slid under fixed bracket 68. At this stage, the anchoring plate of adapter 58 will be at an angle to the top surface of the insert. Once these connections are made, the insert is pushed slowly rearwards into the fireplace cavity. This rearward motion will tend to pivot the front edge of anchor plate 58 into a flat position on top of the insert over aperture 36. Guide flange 66 will guide the movement of adapter 58 over aperture 36. Once the insert is fully inserted into the cavity, movable angled bracket 69 is pushed inwardly to engage bracket 69 over the front edge of the adapter anchoring plate. Together, the fixed bracket and movable bracket ensure that adapter 58 is securely and sealably positioned over aperture 36. Insert 2 can then be secured in place within the fireplace cavity.

If necessary, removal of the insert is accomplished by pulling on extension arm 70 outwardly to remove angled bracket 69 from anchoring plate 58 and releasing the plate. As the insert is withdrawn from the cavity, the motion will break the seal and adapter 58 will tend to rotate rearwardly and upwardly pivoting about fixed bracket 68.

It will be understood that the means for sealably connecting the aperture and the venting passage are not limited to use with a fireplace insert. The connection apparatus is useful whenever it is necessary to connect an outlet port of an enclosure with a venting passage in any enclosed space.

Although the present invention has been described in some detail by way of example for purposes of clarity and understanding, it will be apparent that certain changes and modifications may be practised within the scope of the appended claims.

I claim:

1. A fireplace insert for a fireplace cavity formed within a building, the building further defining a venting passage that includes a flexible duct section, the fireplace insert comprising:

an enclosure dimensioned to be insertable within the fireplace cavity filling substantially the entire cavity to define a combustion chamber for generating heat, the combustion chamber having a combustion chamber outlet;

an adapter plate connected to an end of the flexible duct section for sealably connecting the duct section and the combustion chamber outlet;

a fixed retaining flange adjacent the combustion chamber outlet to engage an edge of the adapter plate prior to insertion of the enclosure within the fireplace cavity; and a slidable retaining flange extending outwardly from the enclosure and positioned to be accessible when the enclosure is in place in the fireplace cavity and moveable between a released position and an engaged position in which the fixed and slidable retaining flanges co-operate to retain the adapter plate in position in the combustion chamber outlet.

2. An insert as claimed in claim 1 in which the enclosure includes heat exchanging means for accepting relatively cool building air, warming the air using the heat generated in the combustion chamber and delivering the warmed air back to the building.

3. An insert as claimed in claim 2 in which said heat exchanging means comprises:

a heat exchange cavity formed about the combustion chamber that includes a cool air inlet cavity below the combustion chamber, an air heating chamber, and a heated air outlet cavity above the combustion chamber.

4. An insert as claimed in claim 3 in which the combustion chamber outlet extends through the heat exchange cavity formed about the combustion chamber.

5. An insert as claimed in claim 4 in which the combustion chamber outlet comprises a plurality of spaced tubes extending from the combustion chamber to deliver hot combustion gases to the venting passage, the tubes extending through the heat exchanging cavity and being spaced to permit flow of air therebetween to increase the surface are of heat exchange and thereby increase the rate of heat transfer.

6. An insert as claimed in claim 4 including means for preventing downdrafts through the venting passage from reaching the combustion chamber.

7. An insert as claimed in claim 6 in which the means for preventing downdrafts comprises:

an upper chamber interposed between the combustion chamber and the venting passage having a draft outlet into the building; and a deflecting plate positioned over the passage means to deflect downdrafts toward the draft outlet.

8. An insert as claimed in claim 3 formed from modular components comprising:

an outer casing;

an insert mountable within the outer casing having a lower base panel and upper roof panel to define the combustion chamber with clearance between the insert and the outer casing defining the heat exchange cavity;

a covering panel for the outer casing; and at least one tube extending between the upper roof panel and the covering panel to define a combustion chamber outlet.

9. An insert as claimed in claim 8 in which the modular components are formed from sheet metal.

10. An insert as claimed in claim 8 in which the lower base panel of the inner insert is adapted to accept a burner unit for generating heat.

11. An insert as claimed in claim 10 in which the burner unit comprises apparatus for burning gas.

12. An insert as claimed in claim 1 in which the adapter plate comprises a tubular portion for insertion into the vent passage.

13. An insert as claimed in claim 12 in which the adapter plate is provided with s seal for engagement with the top of the enclosure.

14. An insert as claimed in claim 12 in which the adapter plate includes a protruding guide flange to guide insertion of the adapter into the combustion chamber outlet.

15. An insert as claimed in claim 12 in which the slidable retaining flange includes an extension arm positioned to protrude from the fireplace cavity when the enclosure is positioned therein, the extension arm and bracket being mounted to the enclosure to permit slidable movement of the retaining flange between the released position and the engaged position.

16. Apparatus for connecting an enclosure having a outlet port to a flexible venting duct in a confined space comprising:

an adapter plate mountable to the end of the flexible venting duct for sealably connecting the duct and the outlet;

a fixed retaining flange associated with the enclosure adjacent the outlet port to engage an edge of the adapter plate prior to insertion of the enclosure within the confined space; and a slidable retaining flange extending outwardly from the enclosure and positioned to be accessible when the enclosure is in place in the confined space and movable between a released position and an engaged position in which the fixed and slidable retaining flanges cooperate to retain the adapter plate in position in the outlet.

* * * * *